US006868252B2

(12) United States Patent
Akiba

(10) Patent No.: US 6,868,252 B2
(45) Date of Patent: Mar. 15, 2005

(54) CLEANING DEVICE AND IMAGE FORMING APPARATUS USING THE SAME

(75) Inventor: Yasushi Akiba, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 84 days.

(21) Appl. No.: 10/159,110

(22) Filed: Jun. 3, 2002

(65) Prior Publication Data

US 2003/0002896 A1 Jan. 2, 2003

(30) Foreign Application Priority Data

Jun. 4, 2001 (JP) ..... 2001-168329
Apr. 19, 2002 (JP) ..... 2002-118179

(51) Int. Cl.[7] ..... G03G 21/00

(52) U.S. Cl. ..... 399/354; 15/256.51; 430/110.4; 430/125

(58) Field of Search ..... 399/98, 99, 343, 399/353, 354; 430/125, 110.1, 110.4, 111.4; 15/1.51, 256.5, 256.51, 256.52

(56) References Cited

U.S. PATENT DOCUMENTS

| | | | | |
|---|---|---|---|---|
| 5,009,973 A | * | 4/1991 | Yoshida et al. | 430/110.4 X |
| 5,083,169 A | * | 1/1992 | Usui et al. | 399/353 |
| 5,111,251 A | * | 5/1992 | Uno et al. | 399/353 X |
| 5,439,770 A | * | 8/1995 | Taya et al. | 430/110.4 X |
| 5,600,405 A | * | 2/1997 | Umeda et al. | 399/354 X |
| 5,618,647 A | * | 4/1997 | Kukimoto et al. | 430/110.4 X |
| 5,659,860 A | | 8/1997 | Sasaki et al. | 399/267 |
| 5,731,122 A | * | 3/1998 | Yoshida et al. | 430/125 X |
| 5,758,241 A | | 5/1998 | Oyama et al. | 399/272 |
| 5,771,429 A | | 6/1998 | Oyama et al. | 399/260 |
| 5,805,965 A | | 9/1998 | Tsuda et al. | 399/281 |
| 5,822,664 A | | 10/1998 | Oka et al. | 399/284 |
| 5,835,837 A | * | 11/1998 | Saitoh et al. | 399/343 |
| 5,857,132 A | | 1/1999 | Mizuishi et al. | 399/66 |
| 5,983,059 A | | 11/1999 | Oka et al. | 399/262 |
| 6,070,043 A | * | 5/2000 | Fujita et al. | 399/354 X |
| 6,091,912 A | | 7/2000 | Kitajima et al. | 399/13 |
| 6,120,864 A | * | 9/2000 | Chiricosta et al. | 15/1.51 X |
| 6,151,471 A | | 11/2000 | Yahata et al. | 399/258 |

FOREIGN PATENT DOCUMENTS

| | | | |
|---|---|---|---|
| JP | 01-116677 | * | 5/1989 |
| JP | 01-295289 | * | 11/1989 |
| JP | 03-017680 | * | 1/1991 |
| JP | 03-077989 | * | 4/1991 |
| JP | 03-078782 | * | 4/1991 |
| JP | 03-116083 | * | 5/1991 |
| JP | 03-191379 | * | 8/1991 |
| JP | 06-138798 | | 5/1994 |
| JP | 06-289759 | * | 10/1994 |
| JP | 06-295146 | * | 10/1994 |
| JP | 07-33260 | | 7/1995 |
| JP | 09-50215 | | 2/1997 |
| JP | 3155421 | | 2/2001 |
| JP | 2001-051549 | * | 2/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

In an image forming apparatus, after the development of a latent image formed on an image carrier effected by using toner, which has a volume mean grain size of 5 μm to 10 μm and in which 60 number percent to 80 number percent of toner grains have a grain size of 5 μm or below, and the transfer of the resulting image to a recording medium, a cleaning device of the present invention removes the toner left on the image carrier with a fur brush. The fur brush is capable of contacting the surface of the image carrier with density high enough to block the toner grains having the above grain size.

18 Claims, 8 Drawing Sheets

FIG. 5

| | DENSITY (FILAMENTS/ $inch^2$) | INTERMITTENT STAINS |
|---|---|---|
| EXAMPLE 1 | 450 | NONE |
| EXAMPLE 2 | 300 | NONE |
| EXAMPLE 3 | 250 | ONE TO FIVE IN A3 IMAGE |
| EXAMPLE 4 | 200 | MORE THAN 100 IN A3 IMAGE |
| EXAMPLE 5 | 150 | MORE THAN 100 IN A3 IMAGE |

FIG. 6

| | RESISTANCE (Ω) | VOLTAGE (V) | BLACK STRIPE |
|---|---|---|---|
| EXPERIMENT 1 | $1\times10^{6}$ | 0 | ○ |
| EXPERIMENT 2 | $1\times10^{8}$ | 0 | ○ |
| EXPERIMENT 3 | $1\times10^{10}$ | 0 | △ (NOT ALWAYS) |
| EXPERIMENT 4 | $1\times10^{12}$ | 0 | × (LOCALLY CONTINUOUSLY) |
| EXPERIMENT 5 | $1\times10^{10}$ | +0.5K | △ (NOT ALWAYS) |
| EXPERIMENT 6 | $1\times10^{10}$ | −1K | ○ |
| EXPERIMENT 7 | $1\times10^{10}$ | −1.5K | ○ |

D = 18 ±0.5
d = 9.5

D = 18 ±0.2
d = 6.0

FIG. 9

| CH | GRAIN SIZE DISTRIBUTION | WEIGHT PERFECT | NUMBER OF PERCENT |
|---|---|---|---|
| 1 | 1.26~1.59 | 0.00 | 0.00 |
| 2 | 1.59~2.00 | 0.00 | 0.00 |
| 3 | 2.00~2.52 | 0.51 | 6.29 |
| 4 | 2.52~3.17 | 2.03 | 12.63 |
| 5 | 3.17~4.00 | 6.02 | 19.26 |
| 6 | 4.00~5.04 | 14.84 | 24.04 |
| 7 | 5.04~6.35 | 26.47 | 21.62 |
| 8 | 6.35~8.00 | 28.37 | 12.10 |
| 9 | 8.00~10.1 | 15.52 | 3.48 |
| 10 | 10.1~12.7 | 4.64 | 0.53 |
| 11 | 12.7~16.0 | 0.86 | 0.05 |
| 12 | 16.0~20.2 | 0.27 | 0.01 |
| 13 | 20.2~25.4 | 0.00 | 0.00 |
| 14 | 25.4~32.0 | 0.00 | 0.00 |
| 15 | 32.0~40.3 | 0.00 | 0.00 |
| 16 | 40.3~50.8 | 0.00 | 0.00 |

FIG. 10

| | VOLUME MEAN GRAIN SIZE (μm) | NUMBER PERCENT OF GRAINS OF 5μm OR BELOW | RESOLUTION |
|---|---|---|---|
| EXAMPLE 1 | 8.51 | 65 | ◎ (5.0) |
| EXAMPLE 2 | 8.51 | 50 | ○ (4.5) |
| EXAMPLE 3 | 11.05 | 65 | ○ (4.5) |
| EXAMPLE 4 | 11.05 | 50 | △ (4.0) |

CLEANING DEVICE AND IMAGE FORMING APPARATUS USING THE SAME

BACKGROUND OF THE INVENTION

1. Field of the Invention

The present invention relates to a cleaning device and an image forming apparatus using the same and more particularly to a structure for cleaning an image carrier included in an image forming apparatus.

2. Description of the Background Art

An electrophotographic process is one of conventional processes available for forming an image corresponding to a document or image information and disclosed in, e.g., U.S. Pat. No. 2,297,091 and Japanese Patent Publication Nos. 49-23910 and 43-24748. It is a common practice with the electrophotographic process to use an image carrier having a photoconductive layer. The photoconductive layer is exposed imagewise or scanned by a light beam to form a latent image representative of a document or image information. In the case of development using dry toner, the latent image is developed by the dry toner to become a toner image. The toner image is transferred to a sheet or recording medium and then fixed thereon by, e.g., heat and pressure.

Developing devices are generally classified into a wet-process developing device and a dry-process developing device. The wet-process developing device uses a developing liquid consisting of an insulative, organic liquid and various kinds of pigments and dyes finely dispersed in the liquid. The dry-process developing device uses a developer implemented as dry toner consisting of natural or synthetic resin and carbon black or similar colorant dispersed in the resin. The dry-process developing device develops a latent image by using any one of a cascade method, a magnet brush method, a powder cloud method and other conventional methods. The developer for the dry-process developing device is either one of toner only and a toner and carrier mixture.

Today, to meet the increasing demand for higher image quality, the grain size of toner for development is decreasing. Particularly, when a latent image is formed in the form of dots by digital processing, toner with a small grain size is often used to enhance reproducibility and sharpness. Toner with a small grain size is taught in, e.g., Japanese Patent Laid-Open Publication Nos. 1-112253, 2-284158 and 7-295283. These documents describe the mean grain sizes of toner and the amounts of toner grains having a mean grain size of 5 $\mu$m or below as well as the distributions of such toner grains specifically. The mean grain size of 5 $\mu$m or below is essential for high definition, high resolution images. Such toner grains faithfully deposit on a latent image without blurring or otherwise disfiguring it.

An edge effect, which is one of problems particular to image formation, is conspicuous when toner with a mean grain size of 5 $\mu$m or below, but can be obviated if the toner contains a particular number percent of grains having grain sizes of 5 $\mu$m and above. Therefore, when use is made of toner with a mean grain size of 5 $\mu$m or below and containing 60 number percent to 80 number percent of grains with a grain size of 5 $\mu$m or above, high definition and high resolution are achievable. Such toner, however, is apt to bring about defective cleaning, as will be described hereinafter.

In an electrophotographic image forming apparatus, after a toner image formed by toner on an image carrier has been transferred to a sheet, the surface of the image carrier is cleaned to remove toner left on the image carrier. One of conventional cleaning devices uses a cleaning blade pressed against the surface of the image carrier for scraping off the residual toner. This type of cleaning device, however, cannot adequately remove the residual toner and makes images defective when use is made of toner with a small grain size for the following reasons.

Toner for development contains not only resin, which is the major component, but also various additives for different purposes. Likewise, sheets contain various additives. Although such additives each are effective for a particular purpose, they are separated from the toner and sheets due to repeated image formation and deposit on the image carrier. It is difficult for the cleaning blade to fully remove the additives, which are fine grains, so that toner with a small grain size accumulates on the surface of the image carrier little by little. This part of the toner is blocked by the fine grains of additives and cannot be easily scraped off despite the action of the cleaning blade.

The toner accumulated on the toner grains left on the drum eventually form masses that do not transmit light in an expected manner. Consequently, stains intermittently appear on the background or the white portion of an image and therefore appear in the resulting toner image in the form of a black stripe, making the toner image defective.

Another problem with toner with a small grain size is that the amount of charge to deposit on the individual toner grain increases, increasing adhesion acting between the toner and the image carrier. This makes it difficult for the cleaning blade to block the toner grains and thereby causes the toner grains moved away from the cleaning blade to form black stripes in the background of an image.

Technologies relating to the present invention are also disclosed in, e.g., Japanese Patent Laid-Open Publication Nos. 6-138798 and 9-50215, Japanese Utility Model Publication No. 7-33260, and Japanese Patent No. 3,155,421.

SUMMARY OF THE INVENTION

It is therefore an object of the present invention to provide a cleaning device capable of surely removing additives separated from toner and sheets from an image carrier to thereby obviate defective images, and an image forming apparatus using the same.

In an image forming apparatus, after the development of a latent image formed on an image carrier effected by using toner, which has a volume mean grain size of 5 $\mu$m to 10 $\mu$m and in which 60 number percent to 80 number percent of toner grains have a grain size of 5 $\mu$m or below, and the transfer of the resulting image to a recording medium, a cleaning device of the present invention removes the toner left on the image carrier with a fur brush. The fur brush is capable of contacting the surface of the image carrier with density high enough to block the toner grains having the above grain size.

BRIEF DESCRIPTION OF THE DRAWINGS

The above and other objects, features and advantages of the present invention will become more apparent from the following detailed description taken with the accompanying drawings in which:

FIG. 5 is a table listing experimental results showing a relation between the density of the fur brush and the occurrence of a defective image;

FIG. 6 is a table listing experimental results showing a relation between the electric characteristic of the fur brush and the occurrence of a defective image;

FIG. 9 is a table showing a relation between weight percent and number percent with respect to the volume mean grain size distribution of a developer; and FIG. 10 is a table showing resolutions estimated with god specific examples 1 through 4.

DESCRIPTION OF THE PREFERRED EMBODIMENT

To better understand the present invention, the problem with the conventional cleaning system of the type using a cleaning blade will be described more specifically. A cleaning blade pressed against a photoconductive element cannot sufficiently remove toner having a small grain size and makes images defective, as stated earlier. This is because various additives added to toner and sheets are too small in grain size to be fully removed by the cleaning blade.

Figure 1A:
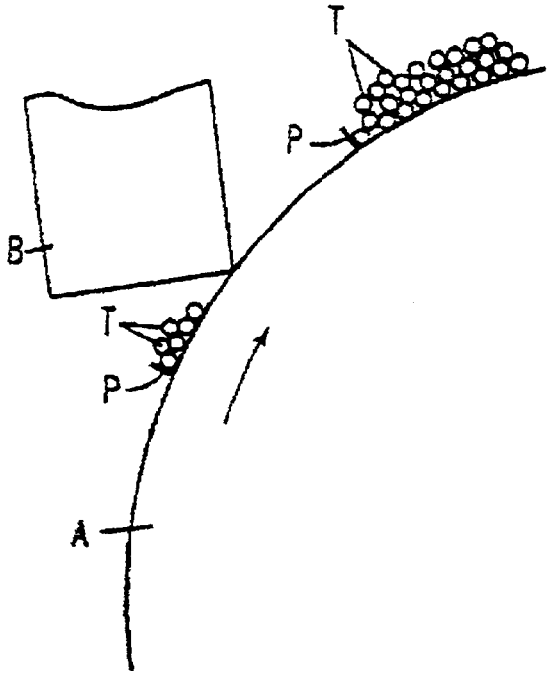
FIG. 1A PRIOR ART
FIGS. 1A and 1B are views for describing the problem with the conventional cleaning scheme more specifically.

More specifically, FIG. 1A shows a cleaning blade B held in contact with the surface of a photoconductive drum A. As shown, assume that the cleaning blade F fails to remove toner grains T from the drum A, and that fine grains P of additives are separated from the toner T and sheets. Then, toner grains T with a small grain size is apt to accumulate around the above toner T and fine grains P. The toner grains accumulated are blocked by the fine grains P and cannot be fully scraped off despite the action of the cleaning blade B.

Figure 1B:
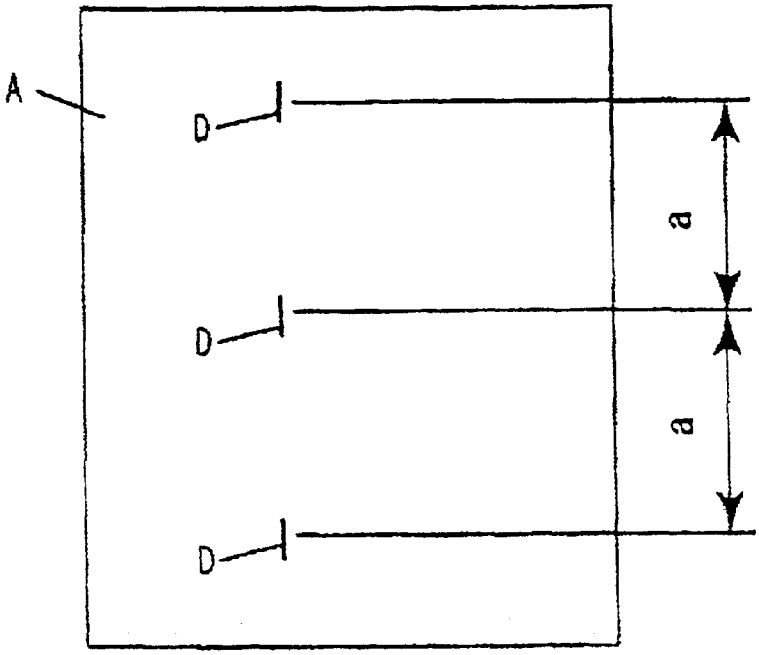
FIG. 1B PRIOR ART

Toner grains accumulate on the toner grains left on the drum A little by little due to repeated image formation and eventually form masses, which do not transmit light in an expected manner. Consequently, as shown in FIG. 1B, stains D intermittently appear on the background or the white portion of an image at intervals a in the circumferential direction of the drum A. The stains appear in the resulting toner image in the form of a black stripe and make the toner image defective.

Figure 2:
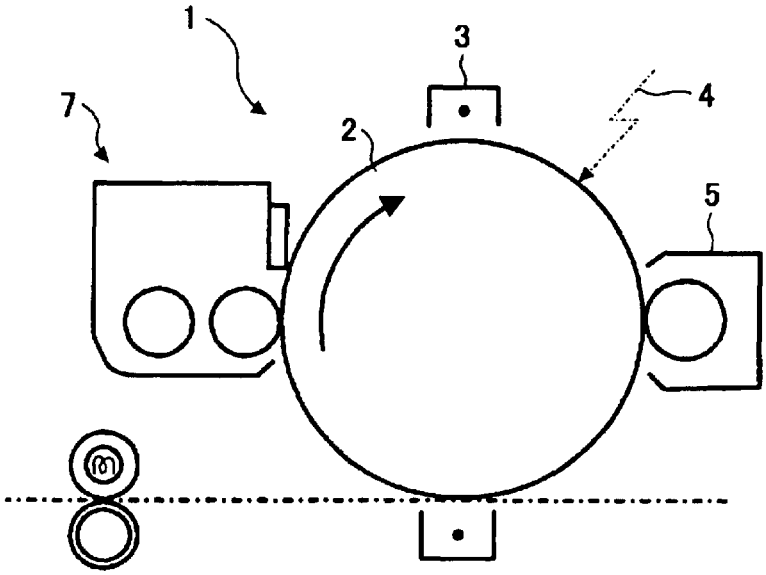
FIG. 2 is a view showing an image forming apparatus including a cleaning device embodying the present invention.

Referring to FIG. 2, an image forming apparatus including a cleaning device embodying the present invention will be described. While the following description will concentrate on a copier of the type forming a latent image on an image carrier with a light beam, the present invention is, of course, similarly applicable to any other image forming apparatus, e.g., a printer or a facsimile apparatus. As shown, the copier, generally 1, includes a photoconductive drum or image carrier 2. Arranged around the drum 2 are a charger 3, an optical writing unit 4, a developing device 5, and a cleaning device 7 for executing an image forming process.

In the illustrative embodiment, the developing device 5 stores a developer implemented as toner having volume mean grain sizes of 5 $\mu$m to 10 $\mu$m and in which 60 number % to 80 number % of toner grains have a grain size of 5 $\mu$m or below. The toner consists of resin and a colorant and may additionally contain wax and inorganic fine grains. The toner may be produced by either one of pulverization and polymerization.

All resins known in the art are applicable to the resin and include styrene, poly-$\alpha$-stylstyrene, styrene-chlorostyrene copolymer, styrene-propylene copolymer, styrene-butadien copolymer, styrene-vinyl chloride copolymer, styrene-vinyl acetate copolymer, styrene-maleic acid copolymer, styrene-acrylate copolymer, styrene-methacrylate copolymer, styrene-$\alpha$-chloromethyl acrylate, styrene-achrilonitrile-acrylate copolymer and other styrene resins (polymers or copolymers containing styrene or styrene substitutes), polyester resin, epoxy resin, vinyl chloride resin, rosin modified, maleic acid resin, phenol resin, polyethylene resin, ketone resin, ethylene-ethylacrylate copolymer, xylene resin, and polyvinyl butyrate resin. Two or more of such resins may be used in combination.

While the colorant is open to choice, use may be made of carbon black, Lamp Black, Iron Black, Ultramarine, Nigrosine Blue, Aniline Blue, Oil Black or Azooil Black by way of example.

The wax may be implemented by any one of conventional waxes including carnauba wax, rice wax and synthetic ester wax. As for inorganic fine grains, use may be made of the powder of silica or titanium oxide by way of example.

FIG. 9 shows a relation between the weight percent and number percent of toner with respect to the distribution of volume mean grain sizes. In the illustrative embodiment, the developer 5 uses toner having a volume mean grain size of 5 $\mu$m to 10 $\mu$m and in which 60 number percent to 80 number percent of toner gains have grain sizes of 5 $\mu$m or below.

Experiments were conducted with the toner having the above volume mean grain size and content in order to determine reproducibility of line images. The line images respectively had 2 lines, 2.2 lines, 2.5 lines, 2.8 lines, 3.2 lines 3.6 lines, 4.0 lines 4 lines, 5 lines, 5.0 lines, 5.6 lines 6.3 lines and 7.2 lines arranged at equal intervals for 1 mm vertically and horizontally. FIG. 10 shows the results of experiments. As shown, the toner with the particular volume mean grain size and particular content stated above realizes high definition, high resolution images.

Figure 3:
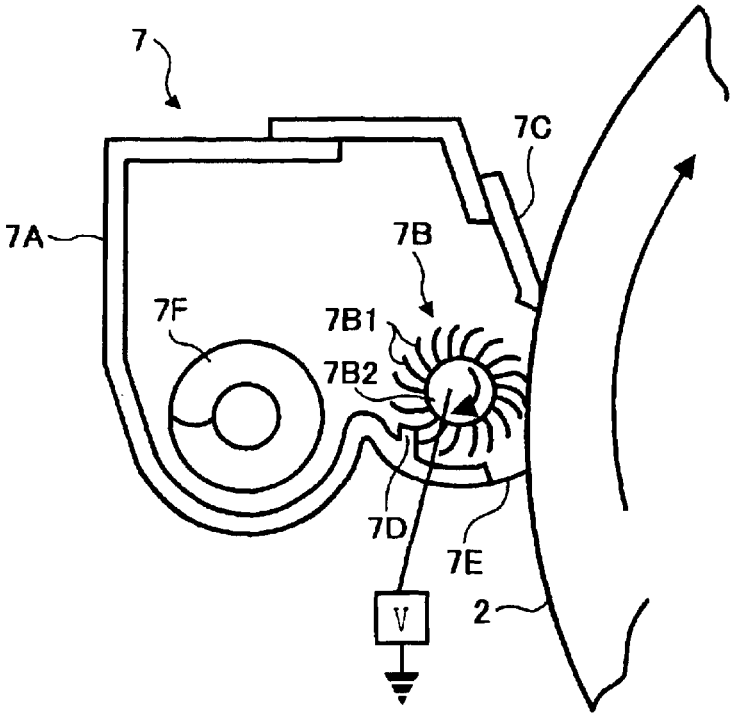
FIG. 3 is a view showing the cleaning device of the illustrative embodiment in detail.

FIG. 3 shows the cleaning device 7 in detail. As shown, the cleaning device 7 includes a housing 7A accommodating a cleaning roller 7B and a cleaning blade 7C. The cleaning roller 7B and cleaning blade 7C are respectively positioned upstream and downstream of the drum 2 in the direction of rotation of the drum 2. A fur brush 7B1 whose configuration will be described later specifically is provided on the surface of the cleaning roller 7B. The cleaning roller 7B is rotatable such that the fur brush 7B1 moves in a direction counter to the direction of movement of the drum 2 in contact with the drum 2.

Figure 4A:
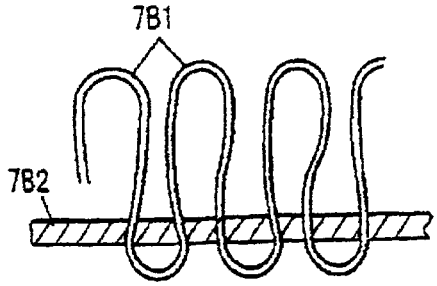
FIG. 4A shows a fur brush forming part of the cleaning device of the illustrative embodiment.
Figure 4B:
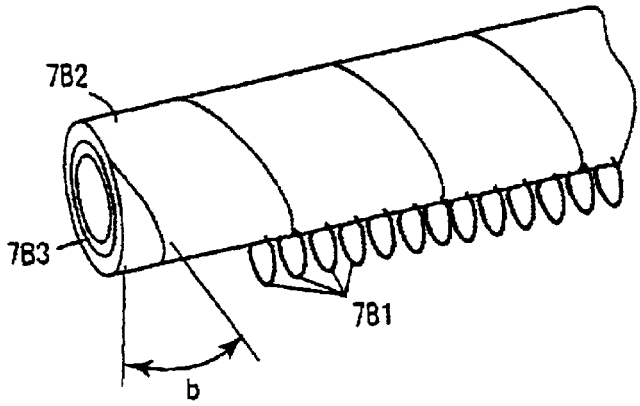
FIG. 4B shows the fur brush wrapped around a core.
Figure 4C:
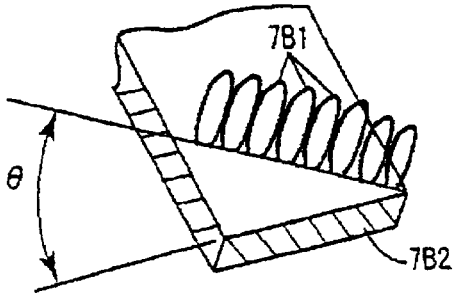
FIG. 4C shows a direction in which the filaments of the fur brush are implanted.

As shown in FIG. 4A, the fur brush 7B1 is made up of a base cloth 7B2 and loop-like filaments implanted in the base 7B2. As shown in FIG. 4B, the base cloth 7B2 is wrapped around a core 7B3 included in the cleaning roller 7B. As shown in FIGS. 4B and 4C, in the illustrative embodiment, the filaments are implanted in the base cloth 7B2 in at an angle $\theta$ coincident with an angle $\theta$ b at which the base cloth 7B2 is wrapped around the core 7B3. Further, the filaments are implanted densely enough to obstruct even toner grains of small grain sizes. More specifically, in the illustrative embodiment, the filaments are implanted in a density of 300 loops for a square inch or above. The filaments are formed of a material chargeable to the same polarity as the toner by friction.

Figure 4D:
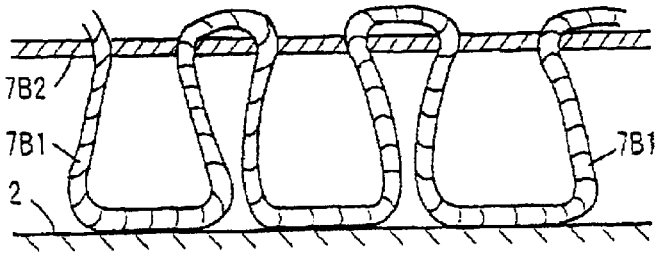
FIG. 4D shows how the filaments of the fur brush contact an image carrier.

The base cloth 7B2 is wrapped around the core 7B3 such that the piles of the loops of the filaments are substantially parallel to the axis of the drum 2. As shown in FIG. 4D, the piles have a length and a diameter selected such that the ends of the filaments opposite to the implanted ends become substantially parallel to the axis of the drum 2 when contacting the surface of the drum 2. The material of the fur brush 7B1 has an electric resistance of $1\times10^8$ Ω or below and connected to ground. During image formation, a voltage opposite in polarity to the toner is applied between the fur brush 7B1 and ground voltage source V.

As stated above, the filaments of the fur brush 7B2 are implanted in the base cloth 7B2 in the direction in which the base cloth 7B2 is wrapped around the core 7B3. Therefore, when the base cloth 7B2 is wrapped around the core 7B3, the filaments of the fur brush 7B1 inclined relative to the base cloth 7B2 with the angle θ taken into account beforehand align in parallel to the axis of the drum 2.

The fur brush 7B1 held in contact with the drum 2 moves in the direction counter to the direction of movement of the drum 2, as seen at the position where they contact each other. Further, the ends of the filaments contacting the drum 2 are substantially parallel to the axis of the drum 2 and therefore contact the drum 2 perpendicularly to the drum 2. This increases the area over which the individual filament contacts the drum 2. This, coupled with the fact that nearby filaments are positioned close enough to block toner grains, allows the fur brush 7B1 to contact the drum 2 substantially continuously in the axial direction of the drum 2.

The fur brush 7B1, which moves in the direction counter to the direction of movement of the drum 2, rubs the surface of the drum 2 with a frictional force based on a difference in linear velocity. In addition, the fur brush 7B1 is constantly pressed against the drum 2 due to the bending rigidity of the filaments. The fur brush 7B1 can therefore remove all of the small toner grains and small additive grains separated from sheets from the surface of the drum 2. Particularly, because the filaments continuously rub the surface of the drum 2 due to the rotation of the core 7B3, they can rub any portion of above surface a plurality of times if the rotation speed of the core 7B3 is adjusted, efficiently removing the impurities.

In the illustrative embodiment, the fur brush 7B1 is implanted in a particular density and provided with a particular electric characteristic, i.e., chargeable to the same polarity as the toner by friction and provided with an electric resistance of $1\times10^8$ Ω, as stated earlier. Under these conditions, a voltage opposite in polarity to the toner is applied to the fur brush 7B1 during image formation, allowing the fur brush 7B1 to scrape off the toner and additives separated from sheets without fail. Further, even when the amount of charge to deposit on the toner tends to increases due to the decrease in grain size, the fur brush 7B1 can reduce the amount of charge and remove the charge left on the drum 2 after image transfer. This successfully promotes the separation of the toner from the drum 2 for thereby increasing the scraping efficiency of the fur brush 7B1.

I experimentally determined a relation between the density and electric resistance of the fur brush 7B1 and defective images, i.e., intermittent stains shown in FIGS. 1A and 1B and black stripes. FIGS. 5 and 6 show the results of experiments. As FIGS. 5 and 6 indicate, defective images can be reduced if the density and electric characteristic of the fur brush 7B1 are adequately selected.

The fur brush 7B 1 contacts the drum 2 and then hits against a flicker bar 7D disposed in the housing 7A when the core 7B3 is in rotation, so that the impurities between the filaments are removed. Further, a seal 7E is positioned in the housing 7A upstream of the fur brush 7B1 in the direction of rotation of the drum 2, preventing the impurities removed by the fur brush 7B1 from leaking out of the housing 7A. A screw 7F is disposed in the housing 7A for conveying the toner removed from the drum 2 to the developing device 5.

Even when the fur brush 7B1 fails to remove some impurities from the drum 2, the cleaning blade 7C scrapes them off. Therefore, the surface of the drum 2 moved away from the cleaning device 7 is substantially free from impurities.

In the illustrative embodiment, the height or length of the fur brush 7B1 above the base cloth 7B2 may be reduced to increases the elasticity and therefore the scraping ability of the fur brush 7B1. The elasticity relates to the bending rigidity of the fur brush 7B1 mentioned earlier and is directed toward higher scraping efficiency based on higher contact pressure between the fur brush 7B2 and the drum 2.

Figure 7A:
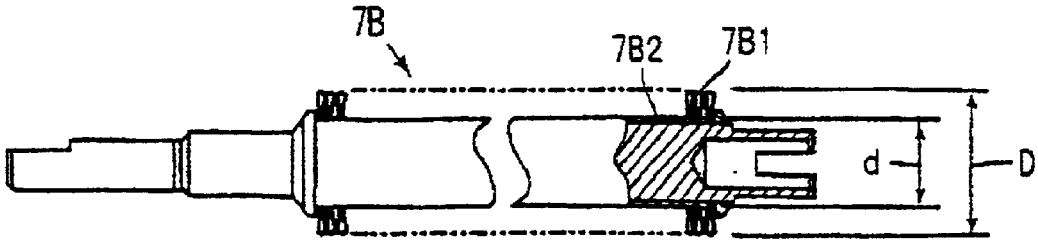
FIGS. 7A and 7B are views for describing the height or length of filaments that constitute the fur brush of the illustrative embodiment.
Figure 7B:
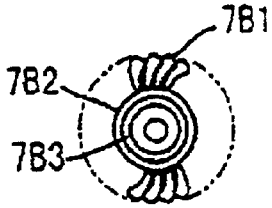
Figure 8A:
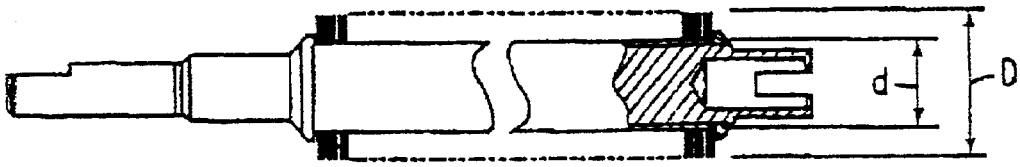
FIGS. 8A and 8B are views for describing the height of length of filaments that constitute the fur brush of a conventional cleaning roller.
Figure 8B:
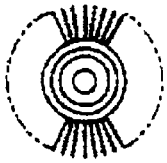

More specifically, FIGS. 7A and 7B show the cleaning roller 7B of the illustrative embodiment while FIGS. 8A and 8B show a conventional cleaning roller in which straight filaments are implanted. In FIGS. 7A and 7B, the fur brush 7B1 has piles implemented by the piles of loop-like filaments and protruding from the core 7B3 to a height lower than the height of the straight filaments shown in FIGS. 8A and 8B. It is to be noted that the above height refers to a difference between the brush diameter D and the core diameter d. The configuration shown in FIGS. 7A and 7B increases the bending rigidity of the piles to thereby cause the piles to fall down little when the cleaning roller 7B is in rotation. It follows that the scraping force based on the rotation torque of the cleaning roller 7B is intensified for enhancing efficient removal of the impurities.

In summary, it will be seen that the present invention provides a cleaning device capable of surely, efficiently removing impurities, i.e., toner and additives from the surface of an image carrier to thereby obviate defective images ascribable to the impurities.

Various modifications will become possible for those skilled in the art after receiving the teachings of the present disclosure without departing from the scope thereof.

What is claimed is:

1. A cleaning device for removing, after development of a latent image formed on an image carrier effected by using toner, which has a volume mean grain size of 5 μm to 10 μm and in which 60 to 80 number percent of toner grains have a grain size of 5 μm or below, and transfer of a resulting image to a recording medium, said toner left on said image carrier, said cleaning device comprising:

a fur brush capable of contacting a surface of the image carrier with a density high enough to block the toner grains having said grain size, wherein said brush has filaments formed of a material chargeable to a same polarity as the toner by friction, and wherein a voltage opposite in polarity to the toner to reach said fur brush is applied between said fur brush and around at least during image formation.

2. The cleaning device as claimed in claim 1, wherein said fur brush moves in a direction counter to a direction of movement of the image carrier, as seen at a position where said fur brush contacts said image carrier.

3. The cleaning device as claimed in claim 2, wherein said fur brush comprises a core, and a base cloth wrapped around said core, and wherein said filaments are loop-like filaments implanted in said base cloth.

4. The cleaning device as claimed in claim 3, wherein said filaments are implanted in said base cloth in a density of 300 loops for a square inch or above in a form of piles.

5. The cleaning device as claimed in claim 4, wherein said fur brush has an electric resistance of $1\times10^8$ Ω or below and is connected to ground.

6. The cleaning device as claimed in claim 3, wherein said base cloth is wrapped around said core such that piles formed by said loop-like filaments are substantially parallel to an axis of the image carrier.

7. The cleaning device as claimed in claim 6, wherein said piles have bending rigidity that causes ends of said filaments opposite to ends implanted in said base cloth to become substantially parallel to the axis of the image carrier when contacting said image carrier.

8. The cleaning device as claimed in claim 1, wherein said fur brush comprises a core, and a base cloth wrapped around said core, and wherein said filaments are loop-like filaments implanted in said base cloth.

9. The cleaning device as claimed in claim 8, wherein said filaments are implanted in said base cloth in a density of 300 loops for a square inch or above in a form of piles.

10. The cleaning device as claimed in claim 9, wherein said fur brush has an electric resistance of $1\times10^8$ Ω or below and is connected to ground.

11. The cleaning device as claimed in claim 8, wherein said base cloth is wrapped around said core such that piles formed by said loop-like filaments are substantially parallel to an axis of the image carrier.

12. The cleaning device as claimed in claim 11, wherein said piles having bending rigidity that causes ends of said filaments opposite to ends implanted in said base cloth to become substantially parallel to the axis of the latent image when contacting said image carrier.

13. The cleaning device as claimed in claim 11, wherein said filaments are implanted in said base cloth in a density of 300 loops for a square inch or above in a form of piles.

14. The cleaning device as claimed in claim 1, wherein said fur brush has an electric resistance of $1\times10^8$ Ω or below and is connected to ground.

15. A cleaning device for removing, after development of a latent image formed on an image carrier effected by using toner, which has a volume mean grain size of 5 μm to 10 μm and in which 60 to 80 number percent of toner grains have a grain size of 5 μm or below, and transfer of a resulting image to a recording medium, said toner left on said image carrier, said cleaning device comprising:

a fur brush capable of contacting a surface of the image carrier with a density high enough to block the toner grains having said grain size, wherein a voltage opposite in polarity to the toner to reach said fur brush is applied between said fur brush and ground at least during image formation.

16. In an image forming apparatus comprising a cleaning device for removing, after development of a latent image formed on an image carrier effected by using toner, which has a volume mean grain size of 5 μm to 10 μm and in which 60 number percent to 80 number percent of toner grains have a grain size of 5 μm or below, and transfer of a resulting image to a recording medium, said toner left on said image carrier, said cleaning device comprising:

a fur brush capable of contacting a surface of the image carrier with a density high enough to block the toner grains having said grain size, wherein said brush has filaments formed of a material chargeable to a same polarity as the toner by friction, and wherein a voltage opposite in polarity to the toner to reach said fur brush is applied between said fur brush and ground at least during image formation.

17. A cleaning device for cleaning toner from an image carrier, said cleaning device comprising:

a fur brush adapted to contact a surface of the image carrier with a density high enough to block toner grains, wherein said brush has filaments formed of a material chargeable to a same polarity as the toner by friction, and wherein a voltage opposite in polarity to the toner to reach said fur brush is applied between said fur brush and ground at least during image formation.

18. A cleaning device for cleaning toner from an image carrier, said cleaning device comprising:

a fur brush adapted to contact a surface of the image carrier with a density high enough to block toner grains, wherein a voltage opposite in polarity to the toner to reach said fur brush is applied between said fur brush and ground at least during image formation.

* * * * *